US011450160B2

(12) United States Patent
Koliparthi et al.

(10) Patent No.: US 11,450,160 B2
(45) Date of Patent: Sep. 20, 2022

(54) WIRELESS ACCESS CONTROL USING AN ELECTROMAGNET

(71) Applicant: CARRIER CORPORATION, Palm Beach Gardens, FL (US)

(72) Inventors: V V N Kanyaka Koliparthi, Telangana (IN); Divya Hariharasubramanian, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/254,885

(22) PCT Filed: Dec. 11, 2019

(86) PCT No.: PCT/US2019/065598
§ 371 (c)(1),
(2) Date: Dec. 22, 2020

(87) PCT Pub. No.: WO2020/123580
PCT Pub. Date: Jun. 18, 2020

(65) Prior Publication Data

US 2021/0295624 A1 Sep. 23, 2021

(30) Foreign Application Priority Data

Dec. 13, 2018 (IN) ..... 201811047206

(51) Int. Cl.
*G07C 9/00* (2020.01)

(52) U.S. Cl.
CPC ..... *G07C 9/00182* (2013.01)

(58) Field of Classification Search
CPC ..... G07C 9/00
See application file for complete search history.

(56) References Cited

U.S. PATENT DOCUMENTS 9,298,281 B2 3/2016 Fullerton et al.
9,454,679 B2 9/2016 Wallner
(Continued)

FOREIGN PATENT DOCUMENTS

CN 108596241 A 9/2018
DE 102017107832 A1 11/2018
EP 1189306 A1 3/2002

OTHER PUBLICATIONS

Holly, R. "Magnetic messaging: Your phone's magnetometer used for new type of communication". Geek.com. Retrieved Nov. 19, 2018 from https://www.geek.com/android/pulse-turns-your-phones-magnetometer-into-a-new-communication-protocol-1598509/. 6 Pages.
(Continued)

*Primary Examiner* — K. Wong
(74) *Attorney, Agent, or Firm* — Cantor Colburn LLP

(57) ABSTRACT

A method of wireless access control using an electromagnet is provided. The method includes detecting encoded data through a magnetic sensor of a mobile device. A wireless communication application is activated on the mobile device based on the encoded data. An access control is interfaced with on a wireless communication interface using the wireless communication application of the mobile device. The wireless communication application is deactivated based on completing a transaction through the wireless communication application on the mobile device.

20 Claims, 5 Drawing Sheets

(56) References Cited

U.S. PATENT DOCUMENTS

| | | | | |
|---|---|---|---|---|
| 9,589,219 | B1 | 3/2017 | Gonzales, Jr. | |
| 9,661,554 | B2 | 5/2017 | Maor | |
| 9,742,475 | B2 | 8/2017 | Pellew et al. | |
| 9,877,189 | B2 | 1/2018 | Xu et al. | |
| 10,001,808 | B1 * | 6/2018 | Quinn | H04M 1/185 |
| 10,034,268 | B1 * | 7/2018 | Hazlewood | H04W 4/02 |
| 10,681,044 | B1 * | 6/2020 | Storm | H04L 63/0861 |
| 10,867,231 | B2 * | 12/2020 | Zand | G06K 19/0723 |
| 2008/0157929 | A1 | 7/2008 | Hilgers et al. | |
| 2012/0169327 | A1 | 7/2012 | Parco et al. | |
| 2015/0371234 | A1 | 12/2015 | Huang et al. | |
| 2017/0277282 | A1 | 9/2017 | Go | |
| 2018/0068145 | A1 | 3/2018 | Todeschini | |
| 2018/0139611 | A1 | 5/2018 | Xu et al. | |
| 2018/0279093 | A1 | 9/2018 | Do et al. | |
| 2018/0326946 | A1 | 11/2018 | Bocca et al. | |

OTHER PUBLICATIONS

International Application No. PCT/US2019/065598 International Search Report and Written Opinion dated Mar. 30, 2020, 18 pages.

Pan et al. "MagneComm: Magnetometer-based Near-Field Communication", MobiCom '17. Proceedings of the 23rd Annual International Conference on Mobile Computing and Networking. Snowbird, Utah, USA—Oct. 16-20, 2017, 13 Pages.

* cited by examiner

WIRELESS ACCESS CONTROL USING AN ELECTROMAGNET

CROSS REFERENCE TO RELATED APPLICATIONS

This application is a National Stage application of PCT/US2019/065598, filed Dec. 11, 2019, which claims the benefit of Indian Provisional Patent Application No. 201811047206, filed Dec. 13, 2018, both of which are incorporated herein by reference in their entirety.

BACKGROUND

The subject matter disclosed herein generally relates to the field of access control systems, and more particularly to an apparatus and method for wireless access control using an electromagnet.

Existing lock systems may allow a person to activate an access control to unlock a lock through a mobile device. Wireless protocols, such as Bluetooth, can enable wireless communication between a mobile device and an access control without the mobile device being directly next to the access control (e.g., within about a 10 meter radius). Access control systems that use wireless communication may be susceptible to relay attacks, where one or more devices are used to relay communication between the mobile device and the access control while the mobile device is not in physical proximity to the access control (e.g., outside of the normal direct communication range between the mobile device and access control). An attacker and/or accomplice performing the relay can then access the previously locked area without the knowledge or consent of the user of the mobile device.

BRIEF SUMMARY

According to one embodiment, a method includes detecting encoded data through a magnetic sensor of a mobile device and activating a wireless communication application on the mobile device based on the encoded data. The method also includes interfacing with an access control on a wireless communication interface using the wireless communication application on the mobile device and deactivating the wireless communication application based on completing a transaction through the wireless communication application on the mobile device.

In addition to one or more of the features described above or below, or as an alternative, further embodiments may include where the encoded data includes one or more access codes detected through a varying magnetic field from an electromagnet.

In addition to one or more of the features described above or below, or as an alternative, further embodiments may include where the wireless communication interface has a greater communication range than the communication between the electromagnet and the magnetic sensor.

In addition to one or more of the features described above or below, or as an alternative, further embodiments may include disabling the wireless communication application after a predetermined period of time based on determining that the magnetic sensor is outside of a communication range with the electromagnet.

In addition to one or more of the features described above or below, or as an alternative, further embodiments may include where the electromagnet is located proximate to the access control.

In addition to one or more of the features described above or below, or as an alternative, further embodiments may include where the access control is operable to control a lock actuator to open a lock.

In addition to one or more of the features described above or below, or as an alternative, further embodiments may include where the wireless communication application is configured to transmit an encrypted mobile credential to the access control using the wireless communication interface based on detecting the encoded data through the magnetic sensor.

In addition to one or more of the features described above or below, or as an alternative, further embodiments may include where the access control is a payment access control operable for making electronic payments.

In addition to one or more of the features described above or below, or as an alternative, further embodiments may include where the access control is an electrically actuated access gate.

In addition to one or more of the features described above or below, or as an alternative, further embodiments may include where the access control is a component of a vehicle, and the encoded data is transmitted through a varying magnetic field from an electromagnet of the vehicle.

According to another embodiment, an access control system includes an electromagnet, an access control, and a mobile device application executable by a mobile device. The mobile device application is configured to detect encoded data through a magnetic sensor of the mobile device, activate a wireless communication application on the mobile device based on the encoded data, interface with an access control on a wireless communication interface using the wireless communication application on the mobile device, and deactivate the wireless communication application based on completing a transaction through the wireless communication application on the mobile device.

According to an embodiment, a method includes controlling an electromagnet to transmit encoded data detectable through a magnetic sensor of a mobile device. The method also includes receiving an encrypted mobile credential from the mobile device through a wireless communication interface of an access control responsive to the mobile device detecting the encoded data, decrypting and validating the encrypted mobile credential, extracting virtual card data from the encrypted mobile credential, and communicating the virtual card data to a lock controller as a virtual card read to open a lock.

Technical effects of embodiments of the present disclosure include enhancement of security features of an access control system to prevent unauthorized access attempts.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
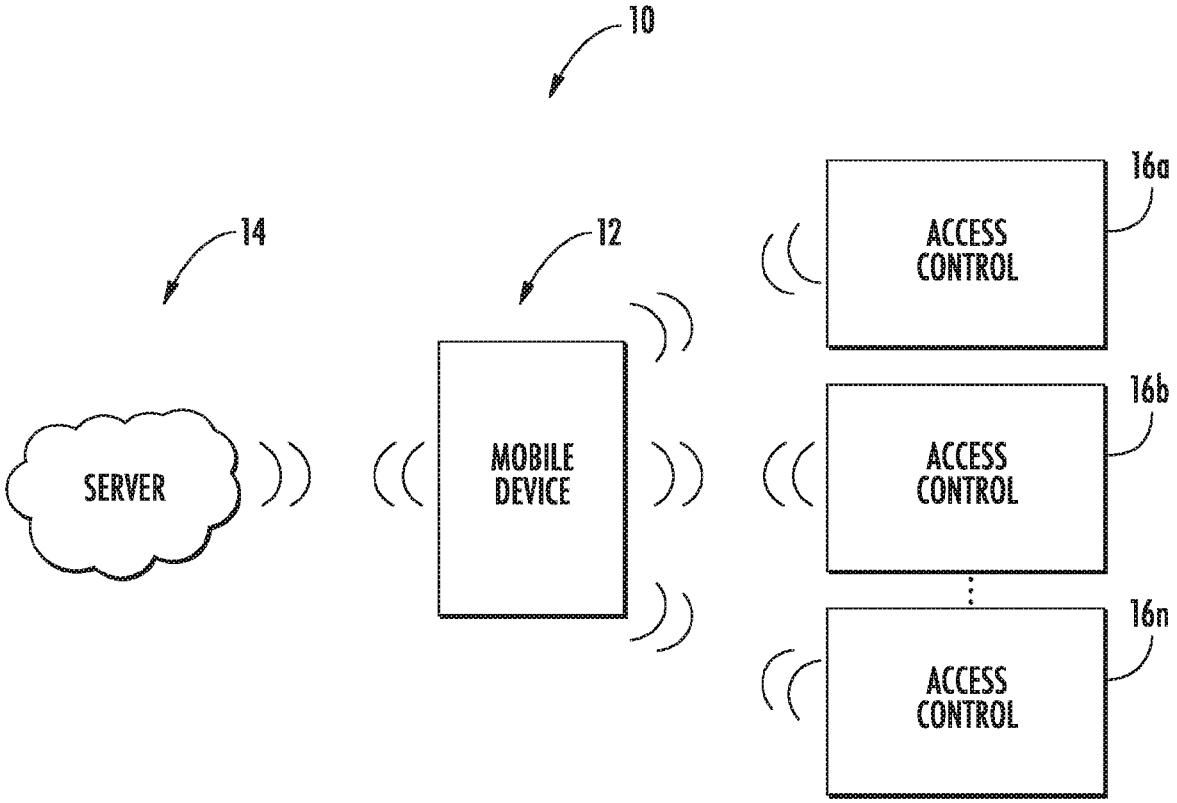
FIG. 1 illustrates a general schematic system diagram of a user authentication system, in accordance with an embodiment of the disclosure.

FIG. 1 schematically illustrates an access control system 10. The system 10 generally includes a mobile device 12, a server 14, and a plurality of access controls 16, schematically illustrated as 16*a*, 16*b*, . . . , 16*n*. It should be appreciated that, although particular systems are separately defined in the schematic block diagrams, each or any of the systems may be otherwise combined or separated via hardware and/or software. In an embodiment, the access controls 16 may control access through a door to a secured area, such as a room of a building. In another embodiment, the access controls 16 may control access to a component of a vehicle, e.g., a storage compartment, a door, an ignition, etc. In another embodiment, the access controls 16 can control operation of an electrically actuated gate, such as a vehicle access gate in a parking lot/structure or a walkway access gate (e.g., an electronic turnstile). In a further embodiment, the access controls 16 can be payment access controls operable for making electronic payments. Other such electronic controls are contemplated within the scope of various embodiments as further described herein.

The mobile device 12 is a wireless capable handheld device such as a smartphone or tablet computer that is operable to communicate with the server 14 and the access controls 16. The server 14 may provide credentials and other data to the mobile device 12, such as firmware or software updates to be communicated to one or more of the access controls 16. Although the server 14 is depicted herein as a single device, it should be appreciated that the server 14 may alternatively be embodied as a multiplicity of systems, from which the mobile device 12 receives credentials and other data.

Each access control 16 is a wireless-capable, restricted-access, or restricted-use device such as wireless locks, access control readers for building entry, electronic banking controls, data transfer devices, key dispenser devices, tool dispensing devices, and other restricted-use machines. The mobile device 12 submits credentials to the access controls 16, thereby selectively permitting a user to access or activate functions of the access controls 16. A user may, for example, submit a credential to an electromechanical lock to unlock it, and thereby gain access to a restricted area. In another example, a user may submit a credential to an electronic banking control to withdraw/transfer funds, for instance, as part of an electronic payment system. In still another example, the user may submit the credential to a unit that dispenses key cards with data associated with or data retrieved from the credential.

A mobile device 12 may store credentials for one or all or other of the examples noted above, and in addition may store a plurality of credentials for each type of application at the same time. Some credentials may be used for multiple access controls 16. For example, a plurality of electronic locks in a facility may respond to the same credential. Other credentials may be specific to a single access control 16.

Figure 2:
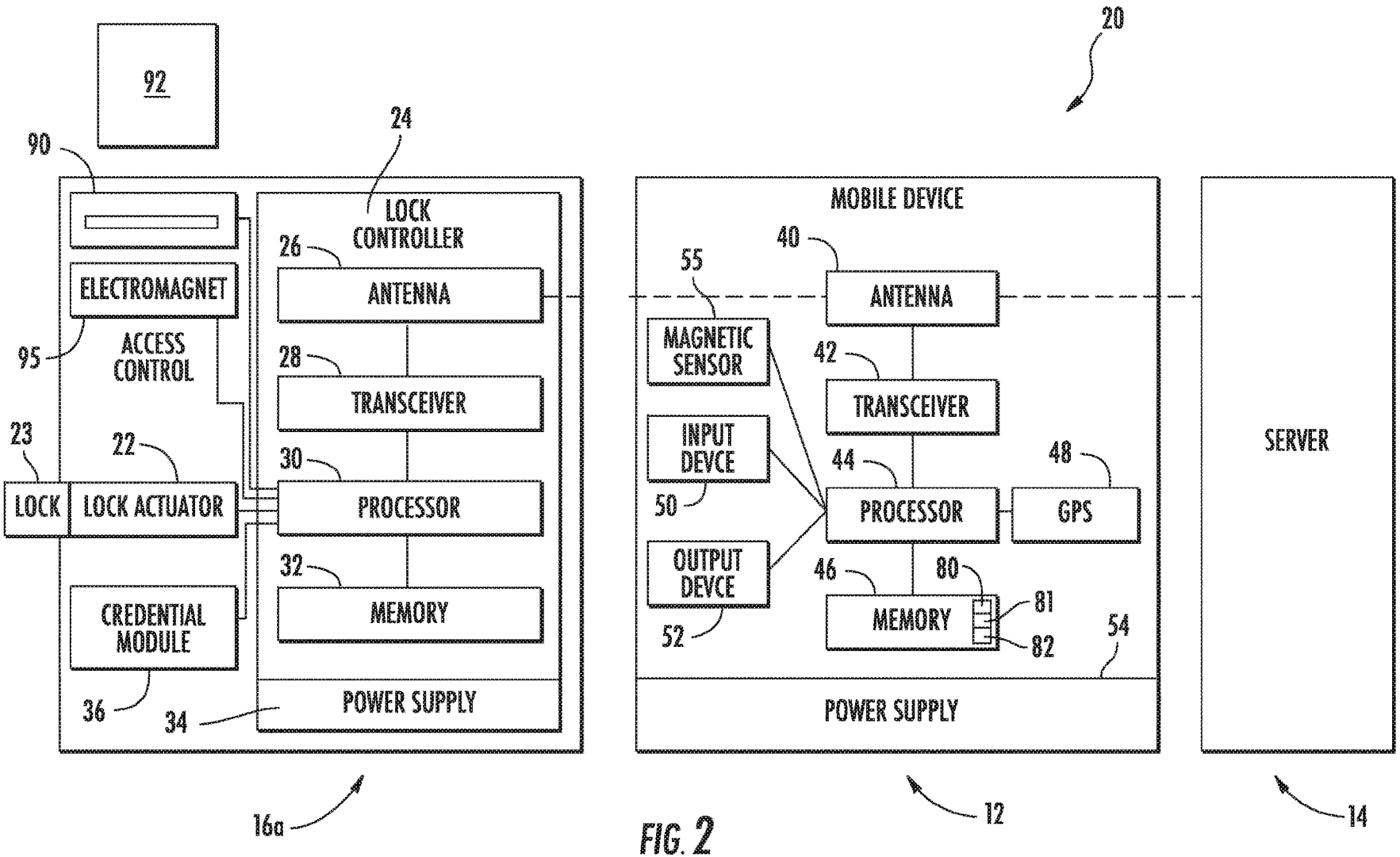
FIG. 2 illustrates a block diagram of the user authentication system, in accordance with an embodiment of the disclosure.

With reference to FIG. 2, a block diagram of an example electronic lock system 20 includes the access control 16*a*, the mobile device 12, and the server 14. The access control 16*a* generally includes a lock actuator 22, a lock controller 24, a lock antenna 26, a lock transceiver 28, a lock processor 30, a lock memory 32, a lock power supply 34, a lock card reader 90 and a credential module 36. The access control 16*a* may have essentially two readers, one reader 90 to read a physical key card 92 and the credential module 36 to communicate with the mobile device 12 via the lock processor 30 and the transceiver 28 and antenna 26. The access control 16*a* is responsive to credentials from the mobile device 12, and may, for example, be a door lock. Although the present disclosure focuses primarily on credentials for access control, it should be appreciated that other systems wherein credentials are transmitted from a mobile device to an access control so as to identify the user to an online system or validate user access rights or permissions in an offline system will benefit herefrom. Such systems include virtual or electronic banking systems, machine operation systems, dispensing systems, and data access systems.

Upon receiving and authenticating an appropriate credential from the mobile device 12 using the credential module 36, or after receiving card data from lock card reader 90, the lock controller 24 commands the lock actuator 22 to lock or unlock a mechanical or electronic lock 23. The lock controller 24 and the lock actuator 22 may be parts of a single electronic or electromechanical lock unit, or may be components sold or installed separately.

The lock transceiver 28 is capable of transmitting and receiving data to and from at least the mobile device 12. The lock transceiver 28 may, for instance, be a near field communication (NFC), Bluetooth, or Wi-Fi transceiver, or another appropriate wireless transceiver. The lock antenna 26 is any antenna appropriate to the lock transceiver 28. The lock processor 30 and lock memory 32 are, respectively, data processing, and storage devices. The lock processor 30 may, for instance, be a microprocessor that can process instructions to validate credentials and determine the access rights contained in the credentials or to pass messages from a transceiver to a credential module 36 and to receive a response indication back from the credential module 36. The lock memory 32 may be RAM, EEPROM, or other storage medium where the lock processor 30 can read and write data including but not limited to lock configuration options and the lock audit trail. The lock audit trail may be a unified audit trail that includes events initiated by accessing the lock via the mobile device 12. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g., turning a bolt).

While FIG. 2 shows the lock antenna 26 and the transceiver 28 connected to the processor 30, this is not to limit other embodiments that may have additional antenna 26 and transceiver 28 connected to the credential module 36 directly. The credential module 36 may contain a transceiver 28 and antenna 26 as part of the credential module 36. Or the credential module 36 may have a transceiver 28 and antenna 26 separately from the processor 30 which also has a separate transceiver 28 and antenna 26 of the same type or different. In some embodiments, the processor 30 may route communication received via transceiver 28 to the credential module 36. In other embodiments the credential module may communicate directly to the mobile device 12 through the transceiver 28. In other embodiments, the credential module 36 may be a software module whole executed within the processor 30.

The mobile device 12 generally includes a key antenna 40, a key transceiver 42, a key processor 44, a key memory 46, a global positioning system (GPS) receiver 48, an input device 50, an output device 52, a key power supply 54, and a magnetic sensor 55. The key transceiver 42 is a transceiver of a type corresponding to the lock transceiver 28, and the key antenna 40 is a corresponding antenna. In some embodiments, the key transceiver 42 and the key antenna 40 may also be used to communicate with the server 14. In other embodiments, one or more separate transceivers and antennas may be included to communicate with server 14. The key memory 46 is of a type to store a plurality of credentials locally on the mobile device 12. In other embodiments, the mobile device 12 communicates with the server 14 at the same time as it communicates to the access control 16*a*. This is the online configuration and in this embodiment, a mobile credential is retrieved in real time and is passed to the credential module 36 without storing first in the key memory 46 on the mobile device 12. The mobile device 12 may also include a mobile device application 80, one or more wireless communication applications 81, and a mobile library 82. Embodiments disclosed herein, may operate through the mobile device application 80, the one or more wireless communication applications 81, and the mobile library 82 installed on the mobile device 12.

In embodiments, the mobile device application 80 can monitor the magnetic sensor 55 to detect encoded data. The magnetic sensor 55 can be an embedded magnetometer operable in some modes of operation as a compass, for example. The mobile device application 80 can repurpose the magnetic sensor 55 to detect encoded data as variations in a magnetic field output, for instance, emitted from an electromagnet 95. The electromagnet 95 may be incorporated in the access control 16*a* or positioned proximate to the access control 16*a*. Upon detecting an access code (e.g., a secret code or message encoded as magnetic field variations of the electromagnet 95 through the magnetic sensor 55), the mobile device application 80 can enable one or more of the wireless communication applications 81 that enable communication between the key antenna 40 and the lock antenna 26, for example. The two-step communication process can limit exposure of the mobile device 12 to attempted relay attacks, as the magnetic sensor 55 must be physically close to the electromagnet 95 before direct access control communication is enabled. In the example of FIG. 2, the electromagnet 95 can be controlled by the lock processor 30 of the access control 16*a* to control the output of encoded data through magnetic field variation control. The magnetic field-based communication between the electromagnet 95 and the magnetic sensor 55 can be a close-range (e.g., about 2 cm) one-way wireless communication, while communication between the key antenna 40 and the lock antenna 26 may have a greater range (e.g. up to 10 m) with two-way communication.

Figure 3:
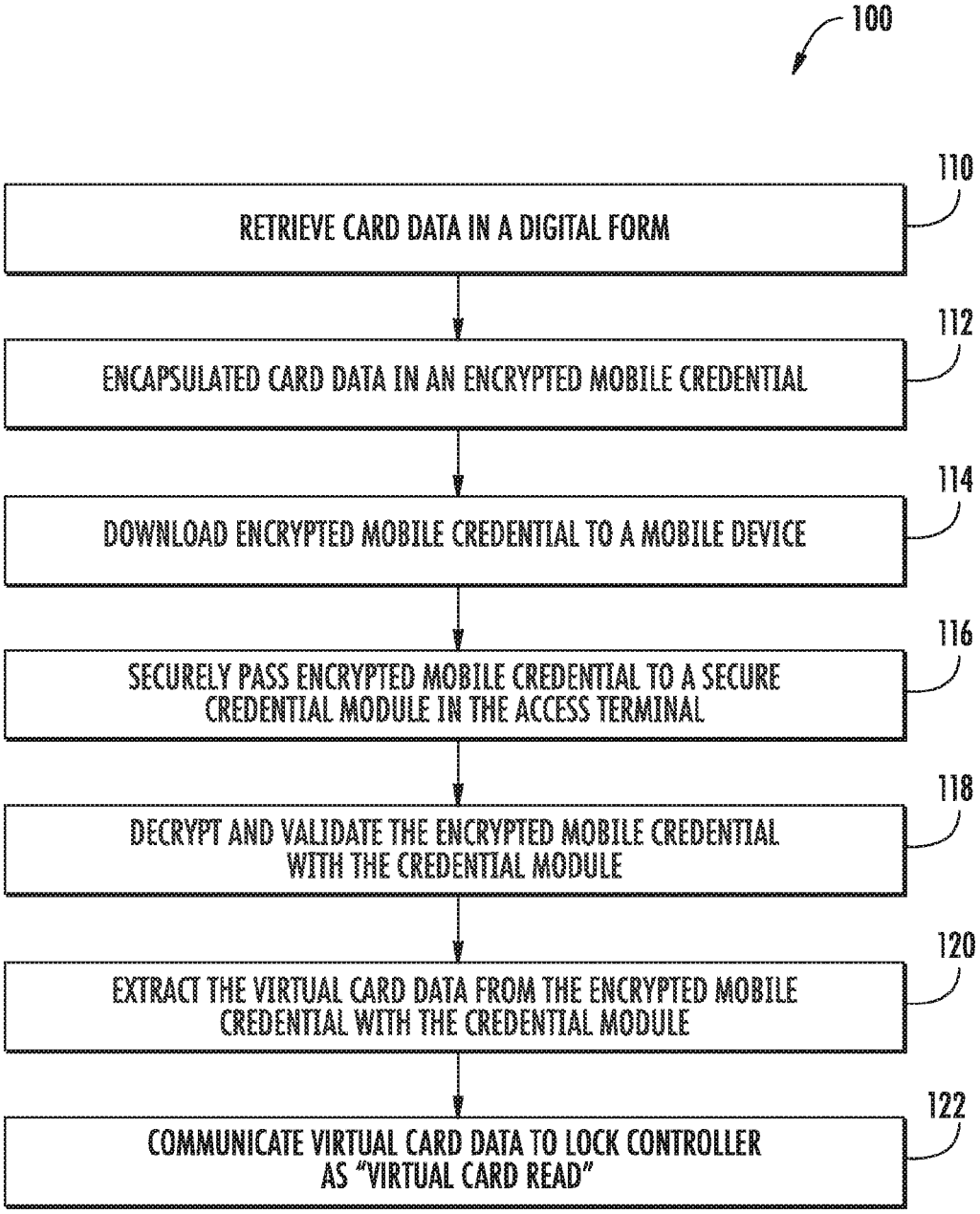
FIG. 3 is a flow diagram illustrating a credential management method performed by a user authentication system, according to an embodiment of the present disclosure.

With reference to FIG. 3, a method 100 to facilitate communication of a credential representative of data that would normally be physically encoded on the key card 92 is retrieved in a digital form (step 110), encapsulated in an encrypted credential (step 112), downloaded to the mobile device 12 (step 114), securely passed to the credential module 36 (step 116) that decrypts and validates the credential (step 118), extracts the virtual card data (step 120), then passes the virtual card data into the lock controller 24 as a "virtual card read" (step 122). This, for example, permits a user to bypass a front desk of a hotel and go directly to their room as will be further described. The encrypted credential may be generated by the server 14 using well-known techniques for digital certificate creation and encryption using cryptographic algorithms such as AES, ECC, RSA, and the like. For example, the credential may contain but is not limited to including a credential identifier, unique access control 16 identifier, unique credential module 36 identifier, an identifier shared with multiple access controls, a parameter indicating the type or format of the credential, it may contain encrypted data such as the virtual card data, and it may contain a digital signature. The encrypted data may be encrypted with an AES-128 encryption key that can be known to the credential module 36. Or it may be encrypted with a derived encryption key that can be determined from information contained in the credential. Further, the digital signature may be a CBC-MAC type signature based on an AES-128 encryption key, for example, that can be known by the credential module 36. Or, it could be a digital signature based on a private key known to the server 14 and can be validated by a public key known to the credential module 36. The securely passing of an encrypted mobile credential of step 116 can include establishing magnetic communication between the mobile device 12 and the electromagnet 95 through transmission of encoded data detectable by the magnetic sensor 55 prior to sending the encrypted mobile credential through the wireless communication interface from the key antenna 40 to the lock antenna 26.

Figure 4:
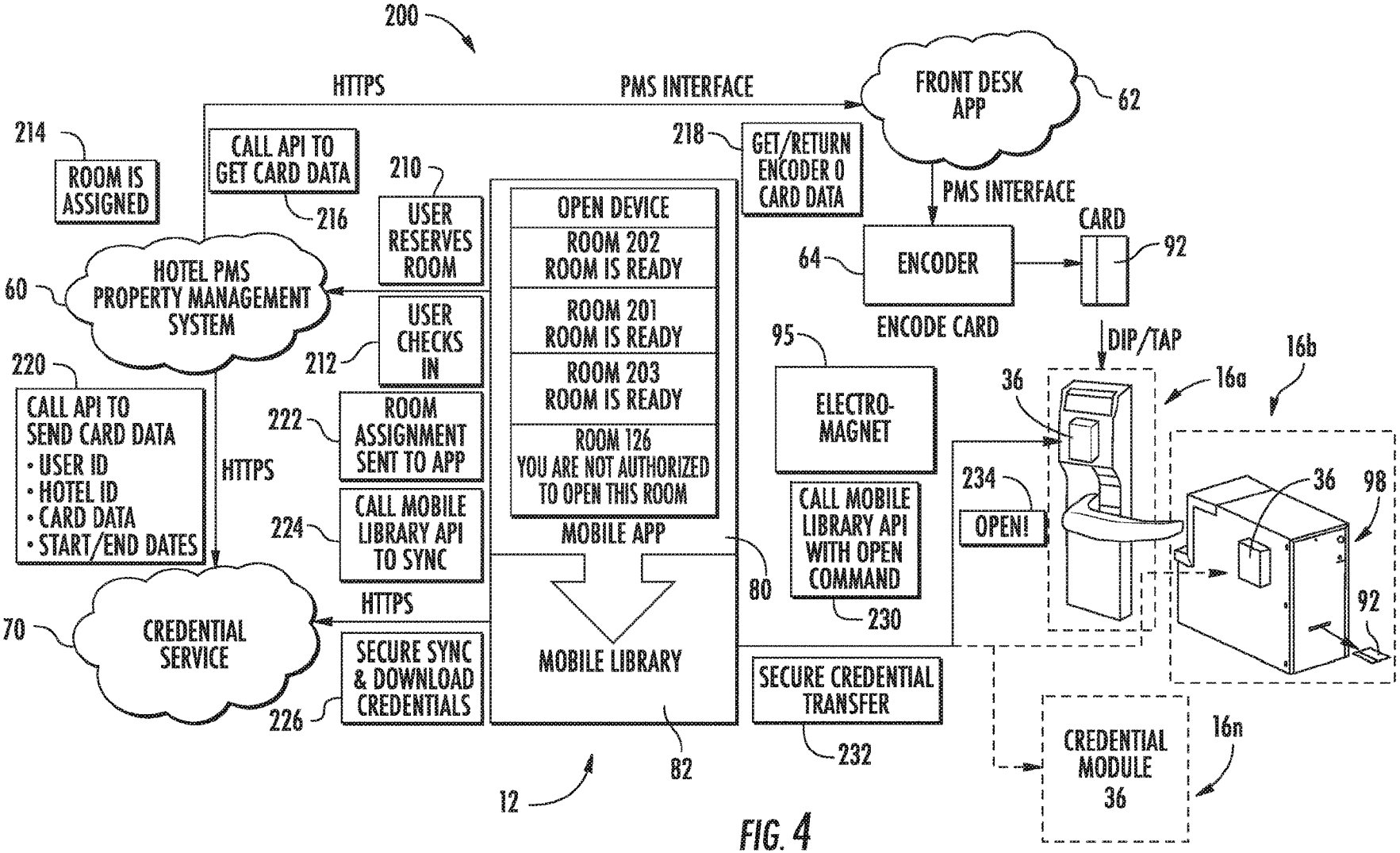
FIG. 4 is a flow diagram illustrating a credential management method, according to an embodiment of the present disclosure.

With reference to FIG. 4, one example of a bypass the front desk method 200, is initiated by a user who first reserves a hotel room (step 210) through any process supported by a hotel, such as mobile reservations, web sites, travel agents, etc. Later, a check-in procedure confirms their stay (step 212). Again, this can be performed through any process supported by the hotel.

Next, a room is assigned in a hotel property management system 60 based on the guest preferences (or room selection) and the room availability on check-in (step 214). The hotel property management system 60 may use a software-to-software application programming interface (API) provided by a front desk application 62 to request card data in a digital form (step 216). The front desk application 62 may range from a stand-alone encoder 64 to a complete software package running in a cloud that is operable to encode a virtual card for the room that was selected and return the virtual card data back to the hotel system (step 218).

Next, the hotel property management system 60 can make another software-to-software API call to a credential service 70 after the hotel system has authenticated the user and has allocated a room stay reservation (step 220). The pertinent information is communicated to the credential service 70 with an indication to include, for example, what hotel property, what room, what guest (e.g. User ID), what dates and also the virtual card data for the stay.

Simultaneous, or in sequence with sending the virtual card data to the credential service 70, the hotel property management service 60 communicates an indication to the user (again, through any conventional method) that the check-in is confirmed and the room is assigned (step 222).

Next, a mobile device 12 based mobile application 80 can utilize a software-to-software API in a mobile library 82 (step 224) to download credentials from the credential service 70 (step 226). The mobile library 82 can securely authenticate to the credential service 70 with a prior established shared secret that may change on every successful connection.

Once authenticated, the credential service 70 can generate at the time of the communication from the mobile library 82 the credentials for the user and encrypts into the credentials the virtual card data received in step 220 for the guest associated with this instance of the mobile library. One credential can be generated for each door or access point and the virtual card data can be the same in each of these separate credentials, but may be encrypted with a unique key for the particular door or access point. The method of encryption may be AES, 3DES, or other such encryption method. The method and type of credential used may be a compressed digital certificate or a standard based certificate like X.509 or other certificate format known to the art. That is, for example, the virtual card data is encrypted into the credential with a unique key known by the credential module 36 and know or determinable by the credential service 70.

The mobile library 82 can download and store the list of credentials on the mobile device 12 using native OS protections and additional encryption of data with device specific information, e.g., UDID, IMEI, IMSI, MAC addresses, etc. Now that the check-in is complete and the encrypted mobile credential (with virtual card data) is resident on the mobile device 12 (FIG. 2), the user can operate the access control 16 in an offline mode at any later time without the mobile device 12 being required to be connected to the credential service 70. Additional embodiments may have the mobile device 12 download a credential at the same time mobile device is communicating to access control 16 at the same time the user wishes to access their room, for example.

When the user wishes to access their room, the mobile device 12 may require proximity confirmation by detecting encoded data from the electromagnet 95 before activating a wireless communication application 81 (FIG. 2) that enables wireless communication interfacing with access control 16. When the encoded data is detected through the magnetic sensor 55 (FIG. 2), the mobile application 80 can again call the software-to-software API in the mobile library 82 to activate the wireless communication application 81 to initiate the secure transfer of the encrypted mobile credential to the access control 16 (step 230). While the application 81 initiates the transfer, the mobile library 82 can implement the secure transfer separately in the next step.

Secure transfer of the credential (step 232) may start with a process of the mobile library 82 listening for a signal advertisement, such as Bluetooth-low energy (BTLE) advertisements from in-range access controls 16. That is, the access controls 16 are advertising their presence on a periodic rate with advertisement data that indicates an identifier of the access control 16 and the mobile device 12 can listen and connect automatically without the person having to push a button to wake-up a sleeping, battery powered lock or to get out of a vehicle to interact with a reader access point on a garage door or other device. The reader access point is another type of lock. Another embodiment is to use Near Field Communication (NFC) and the user 'taps' their mobile device 12 to the access control 16 and a secure credential exchange transfers the mobile credential to the access control 16 (step 232). Secure credential exchanges can be done using standard techniques such as establishing a session key, encrypting communication messages, and validating the authenticity of message sender and receiver. The mobile library 82 can initiate a wireless connection, and perform a secure transfer of the encrypted mobile credential (step 232). The secure transfer may utilize a unique session encryption key and standard cryptographic algorithms and techniques. It should be appreciated that the data can be securely transmitted over any wireless link, to include but not be limited to BTLE, ZigBee, Near Field Communication (NFC), etc.

The credential module 36 can receive the encrypted mobile credential, then validate and decrypt the encrypted mobile credential to retrieve the virtual card data. The decryption and validation may include, but not be limited to, validating a digital signature, validating the type of the credential, validating that the credential identifier matches an identifier in the lock memory 32, validating a starting date and an expiring date of the credential, validating the source of the credential, etc. (step 118; FIG. 3). Once validated and decrypted, the virtual card data is extracted (step 120; FIG. 3).

The virtual card data can then be communicated via hardware and software interfaces, depending on embodiments, to the lock controller 24, which may further decrypt the virtual card data, processes the data based on lock vendor rules, then open the lock 23 if entry is permitted (step 234). Notably, the virtual card data is communicated into the lock controller 24 as a "virtual card read" in a data format equivalent to that of a physical key card. This thus permits the continued usage of traditional guest key cards 92 such as that of a family member, or a guest that just wants a copy of the physical key card 92, along with usage of the mobile device 12.

The audit trail uploaded by the mobile device 12 can be just the audits generated by the mobile device 12 itself, or can be the unified audits including openings by the guest using a physical key card. In addition, when the lock 23 is opened, a battery status or other maintenance information thereof may be uploaded into the audit trail from the mobile device 12 to the credential service 70 so that the hotel can be notified of low battery conditions and proactively change the batteries, or perform other maintenance. Other information associated with the audit trail can include, for example, failed openings or failed attempts or credentials that failed validation.

Usage of the "virtual card read" maintains a contiguous audit trail and also maintains all the known use cases for access control that are already encoded into traditional card data. Furthermore, the credential module 36 is lock vendor agnostic, so that any lock vendor's data could be passed through to allow each lock vendor to independently innovate card data. Further, the credential module 36 may be supplied by a different company than the access control 16. The server 14, mobile device 12, and credential module 36 may have no means for further decrypting or validating the card data other than treating it like a data object to be encoded, encrypted, transferred, retrieved and delivered. Additionally, the "virtual card read" can be used offline without requiring the mobile device 12 to be online with a Wi-Fi connection or real time connection to a credential service. That is, the data for the "virtual card read" is stored on the mobile device 12 and passed securely to the credential module 36 in an offline mode. This is not to limit the capability to also send the "virtual card read" in an online mode. An additional benefit is that any access controls 16 can use any card types in addition to using a credential module 36, where the card types include but are not be limited to, Magnetic strip, RFID, Proximity, etc.

In another disclosed non-limiting embodiment, the credential module 36 can be used for many purposes, to include, but not be limited to, passing data to a self-service hard-key dispenser unit 98 that produces physical key cards 92. The hard-key dispenser unit 98 has a credential module 36 that receives the virtual card data, decrypts, extracts and sends to a lock controller 24 configured to encode the data onto a physical key card 92. That is, the virtual card data on the mobile device 12 is written to a physical key card 92 by the unit 98 and dispenses the key card 92 in an automated manner. The unit 98 does not require any user interface besides the dispensing element for the key card 92 and a unit power source, including but not limited to batteries, mains power, energy harvesting, and the like. The user interface for the unit 98 is really the interface of the mobile device 12. When the unit 98 begins to run low on blank key cards 92, the mobile device 12 can upload to the credential service 70 as indication of the status that can be turned into a report to notify the hotel that the unit 98 needs to be refilled.

In other disclosed non-limiting embodiments, the virtual card data can be standard access control card data (i.e., identification data) for badge access systems, or integrated into a vending machine with the virtual card data as credit card information, tokens, purchase reference identifiers, or the like.

Figure 5:
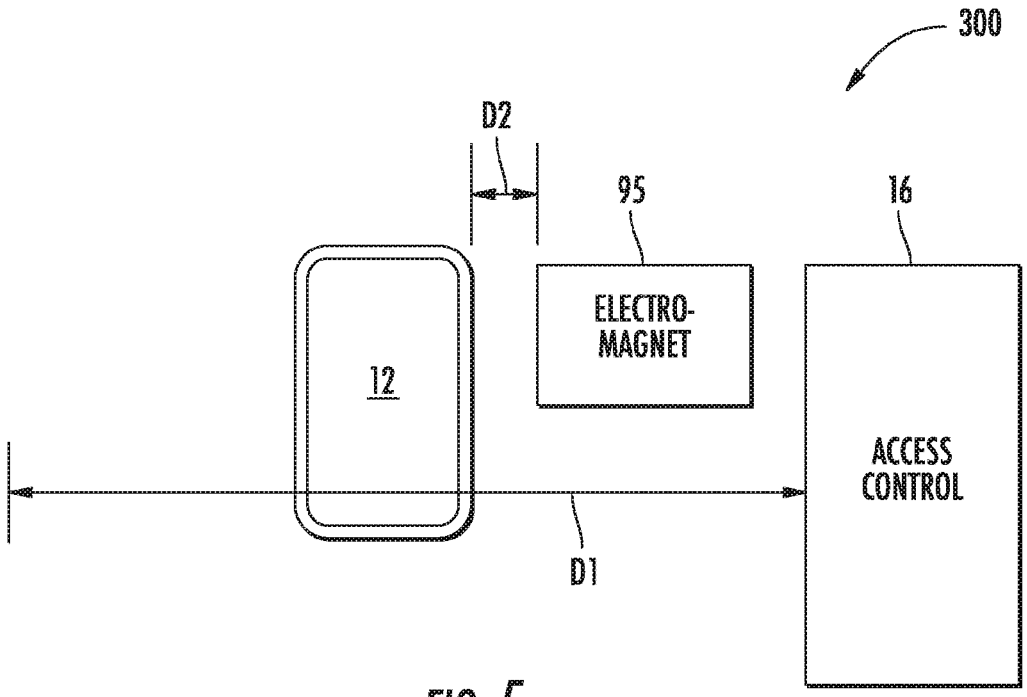
FIG. 5 illustrates a block diagram of an access control system according to an embodiment of the present disclosure.

Referring now to FIG. 5, while referencing FIGS. 1-4. FIG. 5 depicts an example of separation distances to secure communication and prevent relay attacks. A first communication range D1 between the mobile device 12 and the access control 16 can be defined based on the type of wireless communication protocol used. For instance, some wireless communication protocols may have a limit of about 20 cm, while other wireless communication protocols may extend to multiple meters. In either case, using such a wireless protocol may expose the mobile device 12 to relay attacks where another device (not depicted) intercepts communications from the mobile device 12, relays the communications to the access control 16, and relays responses from the access control 16 back to the mobile device 12. A second communication range D2 between the electromagnet 95 and the mobile device 12 is much less (e.g., about 2 cm) than the first communication range D1, such that a relay device cannot reasonably be inserted between the mobile device 12 and the electromagnet 95 and perform a relay attack using magnetic communication. Wireless communication between the mobile device 12 and the access control 16 can be disabled until the mobile device 12 establishes magnetic communication with the electromagnet 95 within the second communication range D2. The electromagnet 95 can be in close proximity to the access control 16 and/or may share a housing with the access control 16. When the electromagnet 95 is external to the access control 16, the electromagnet 95 may be concealed within another housing, positioned behind a poster, or otherwise hidden from plain site.

Figure 6:
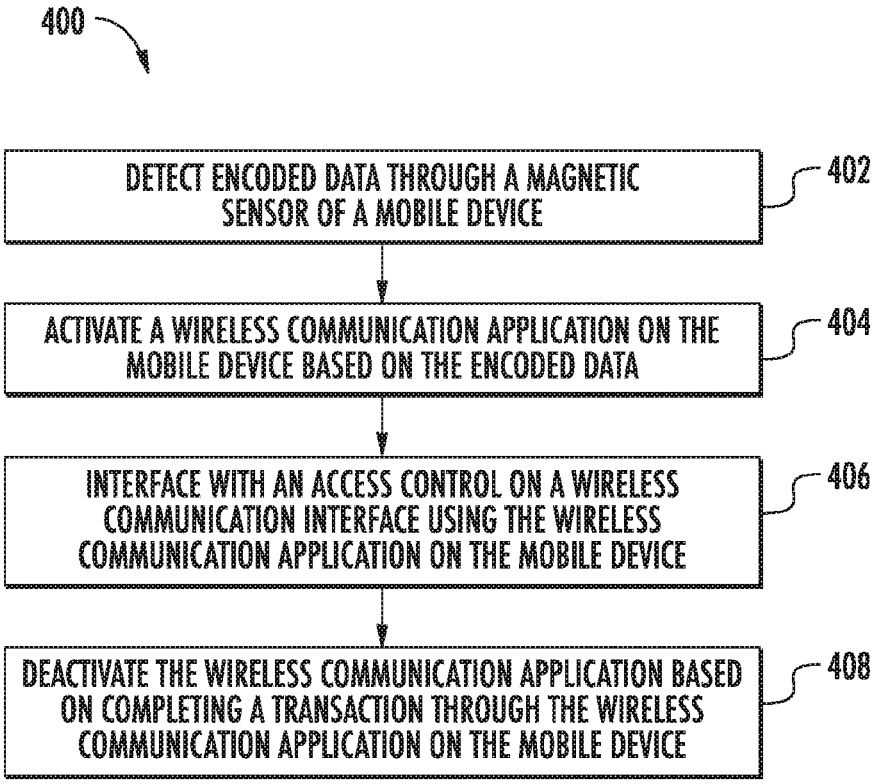
FIG. 6 is a flow diagram illustrating a secure communication process between a mobile device and an access control, according to an embodiment of the present disclosure.

FIG. 6 depicts a flow chart of method 400 of a secure communication process between a mobile device 12 and an access control 16, in accordance with an embodiment of the disclosure. Steps of the method 400 may be performed by the mobile device application 80 on the mobile device 12.

At block 402, the mobile device 12 detects encoded data from the electromagnet 95 through a magnetic sensor 55 of the mobile device 12. The encoded data can be a secret activation code (e.g., one or more access codes) communicated through a varying magnetic field of the electromagnet 95.

At block 404, the mobile device 12 activates a wireless communication application 81 on the mobile device 12 based on the encoded data. At block 406, the mobile device 12 interfaces with the access control 16 on a wireless communication interface (e.g., between the key antenna 40 and the lock antenna 26) using the wireless communication application 81 on the mobile device 12. The wireless communication application 81 may have access to the mobile library 82 and can implement a wireless communication protocol through the key transceiver 42 and key antenna 40 using, for instance, NFC, Bluetooth, RFID, or other known wireless protocols. The wireless communication application 81 can be configured to transmit an encrypted mobile credential to the access control 16 using the wireless communication interface based on detecting the encoded data through the magnetic sensor 55.

At block 408, the mobile device 12 can deactivate the wireless communication application 81 based on completing a transaction through the wireless communication application 81 on the mobile device 12. For instance, after the wireless communication application 81 is activated and the secure credential transfer 232 is completed, the wireless communication application 81 can be deactivated. In some embodiments, the mobile device 12 must continue to detect the encoded data at the magnetic sensor 55 to keep the wireless communication application 81 active. In other embodiments, a timeout period can be used, where the wireless communication application 81 may be disabled after a predetermined period of time based on determining that the magnetic sensor 55 is outside of a communication range with the electromagnet 95 (e.g., greater than the second communication range D2 such that communication is lost).

While the above description has described the flow process of FIG. 3-6 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method comprising:

detecting encoded data through a magnetic sensor of a mobile device;

activating a wireless communication application on the mobile device based on the encoded data;

interfacing with an access control on a wireless communication interface using the wireless communication application on the mobile device; and deactivating the wireless communication application based on completing a transaction through the wireless communication application on the mobile device.

2. The method of claim 1, wherein the encoded data comprises one or more access codes detected through a varying magnetic field from an electromagnet.

3. The method of claim 2, wherein the wireless communication interface has a greater communication range than the communication between the electromagnet and the magnetic sensor.

4. The method of claim 3, further comprising:

disabling the wireless communication application after a predetermined period of time based on determining that the magnetic sensor is outside of a communication range with the electromagnet.

5. The method of claim 2, wherein the electromagnet is located proximate to the access control.

6. The method of claim 1, wherein the access control is operable to control a lock actuator to open a lock.

7. The method of claim 6, wherein the wireless communication application is configured to transmit an encrypted mobile credential to the access control using the wireless communication interface based on detecting the encoded data through the magnetic sensor.

8. The method of claim 1, wherein the access control is a payment access control operable for making electronic payments.

9. The method of claim 1, wherein the access control comprises an electrically actuated access gate.

10. The method of claim 1, wherein the access control is a component of a vehicle, and the encoded data is transmitted through a varying magnetic field from an electromagnet of the vehicle.

11. An access control system comprising:

an electromagnet;

an access control; and a mobile device application executable by a mobile device and configured to:

detect encoded data through a magnetic sensor of the mobile device;

activate a wireless communication application on the mobile device based on the encoded data;

interface with an access control on a wireless communication interface using the wireless communication application on the mobile device; and deactivate the wireless communication application based on completing a transaction through the wireless communication application on the mobile device.

12. The access control system of claim 11, wherein the encoded data comprises one or more access codes detectable through a varying magnetic field from the electromagnet.

13. The access control system of claim 11, wherein the wireless communication interface has a greater communication range than the communication between the electromagnet and the magnetic sensor.

14. The access control system of claim 13, wherein the mobile device application executable by the mobile device is further configured to disable the wireless communication application after a predetermined period of time based on determining that the magnetic sensor is outside of a communication range with the electromagnet.

15. The access control system of claim 11, wherein the access control is operable to control a lock actuator to open a lock.

16. The access control system of claim 15, wherein the wireless communication application is configured to transmit an encrypted mobile credential to the access control using the wireless communication interface based on detecting the encoded data through the magnetic sensor.

17. The access control system of claim 11, wherein the access control is a payment access control operable for making electronic payments.

18. The access control system of claim 11, wherein the access control comprises an electrically actuated access gate.

19. The access control system of claim 11, wherein the access control is a component of a vehicle, and the encoded data is transmitted through a varying magnetic field from the electromagnet of the vehicle.

20. A method comprising:

controlling an electromagnet to transmit encoded data detectable through a magnetic sensor of a mobile device;

receiving an encrypted mobile credential from the mobile device through a wireless communication interface of an access control responsive to the mobile device detecting the encoded data;

decrypting and validating the encrypted mobile credential;

extracting virtual card data from the encrypted mobile credential; and communicating the virtual card data to a lock controller as a virtual card read event to open a lock.

* * * * *